US005560306A

United States Patent [19]

Kyuno et al.

[11] Patent Number: 5,560,306

[45] Date of Patent: Oct. 1, 1996

[54] EMBROIDERY DATA PRODUCING APPARATUS AND PROCESS FOR FORMING EMBROIDERY

[75] Inventors: Mitsuyasu Kyuno, Aichi-ken; Yukiyoshi Muto; Masao Futamura, both of Nagoya; Masahiro Mizuno, Kasugai, all of Japan

[73] Assignee: Brother Kogyo Kabushiki Kaisha, Nagoya, Japan

[21] Appl. No.: 246,709

[22] Filed: May 20, 1994

[30] Foreign Application Priority Data

Jun. 14, 1993 [JP] Japan ..... 5-141846

[51] Int. Cl.[6] ..... D05B 21/00; D05C 9/06

[52] U.S. Cl. ..... 112/102.5; 112/475.19; 364/470.09

[58] Field of Search ..... 112/121.12, 103, 112/262.3, 266.1, 439, 454, 456, 457, 453, 102.5, 470.06, 475.19, 475.04; 364/470

[56] References Cited

U.S. PATENT DOCUMENTS 5,189,623 2/1993 Komuro et al. .
5,191,536 3/1993 Komuro et al. .
5,195,442 3/1993 Meier ..... 112/266.1
5,231,586 7/1993 Shimizu ..... 112/103 X

*Primary Examiner*—Peter Nerbun
*Attorney, Agent, or Firm*—Oliff & Berridge

[57] ABSTRACT

Apparatus and process for producing embroidery data to control a sewing machine to form, on a work sheet, an embroidery by sequentially filling with stitches a plurality of closed areas separate from each other. The apparatus includes a memory which stores a plurality of sets of closed-area data each of which represents a corresponding one of the closed areas; and a producing device for producing, based on the sets of closed-area data, the embroidery data to control the sewing machine to embroider each of the closed areas by starting and ending at at least one of (a) a substantially same position and (b) respective positions adjacent to each other. The process includes the step of producing the embroidery data to control the sewing machine to embroider each of the closed areas by starting and ending at at least one of (a) a substantially same position and (b) respective positions adjacent to each other. An embroidering product having an embroidery formed by filling with stitches a plurality of closed areas separate from each other, wherein the improvements include: each of the closed areas being embroidered by starting and ending at at least one of (a) a substantially same position and (b) respective positions adjacent to each other.

30 Claims, 8 Drawing Sheets

FIG. 3
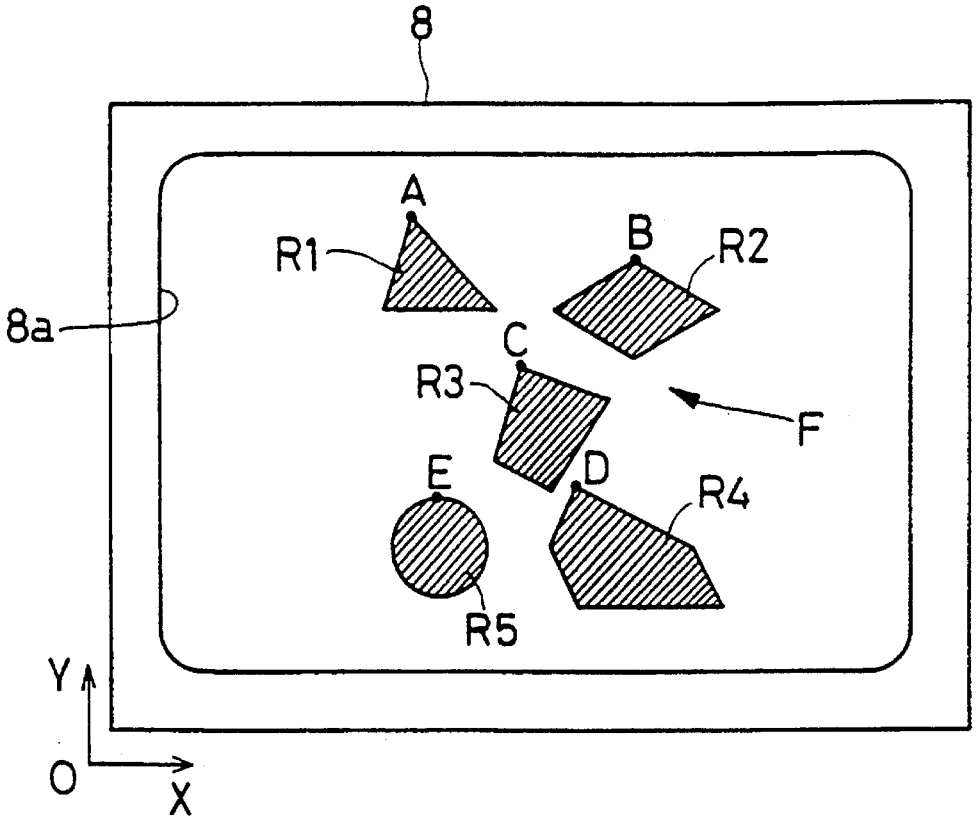
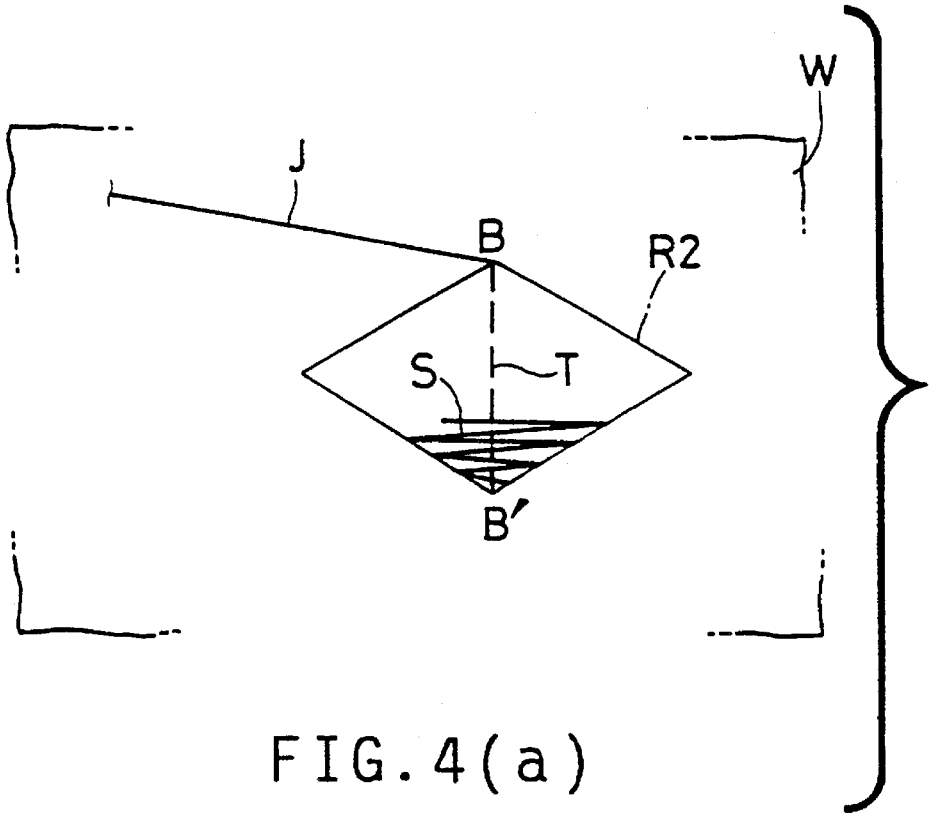
FIG. 4(a)

FIG. 5
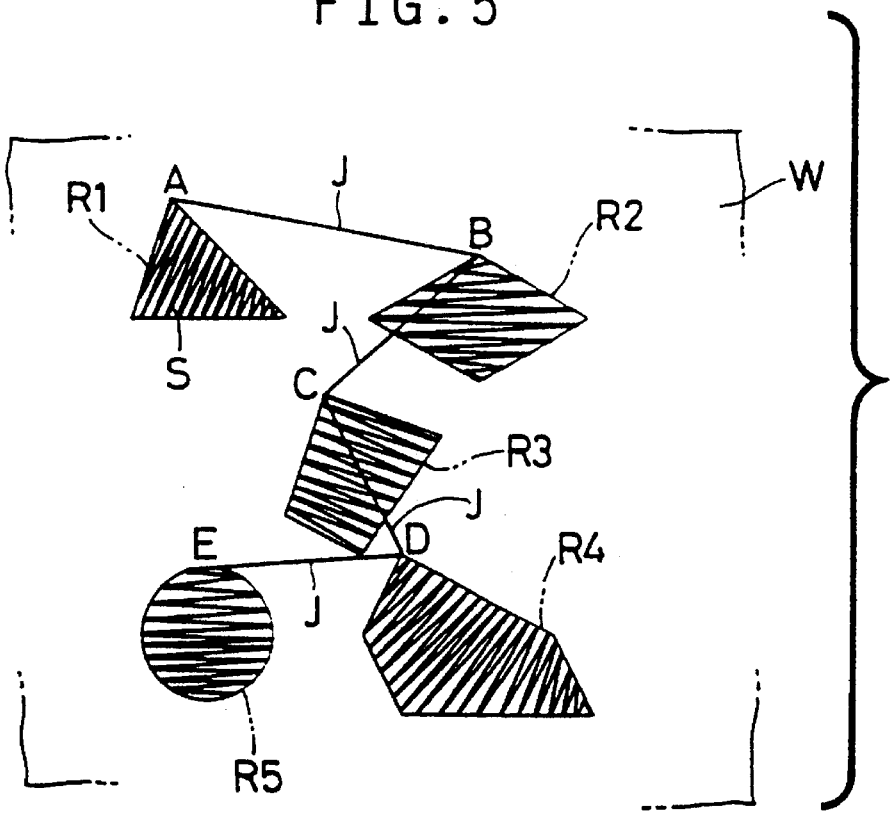
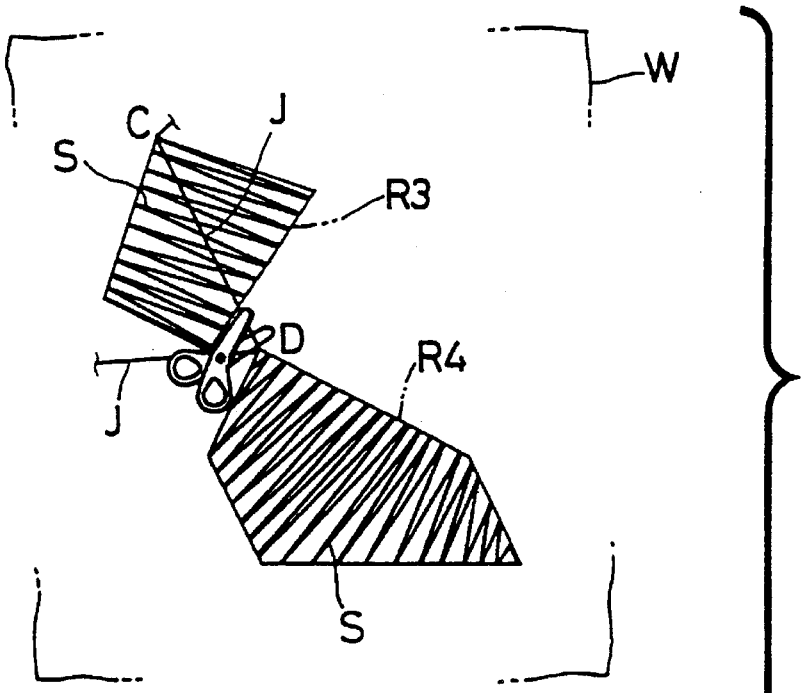
FIG. 6

FIG. 7
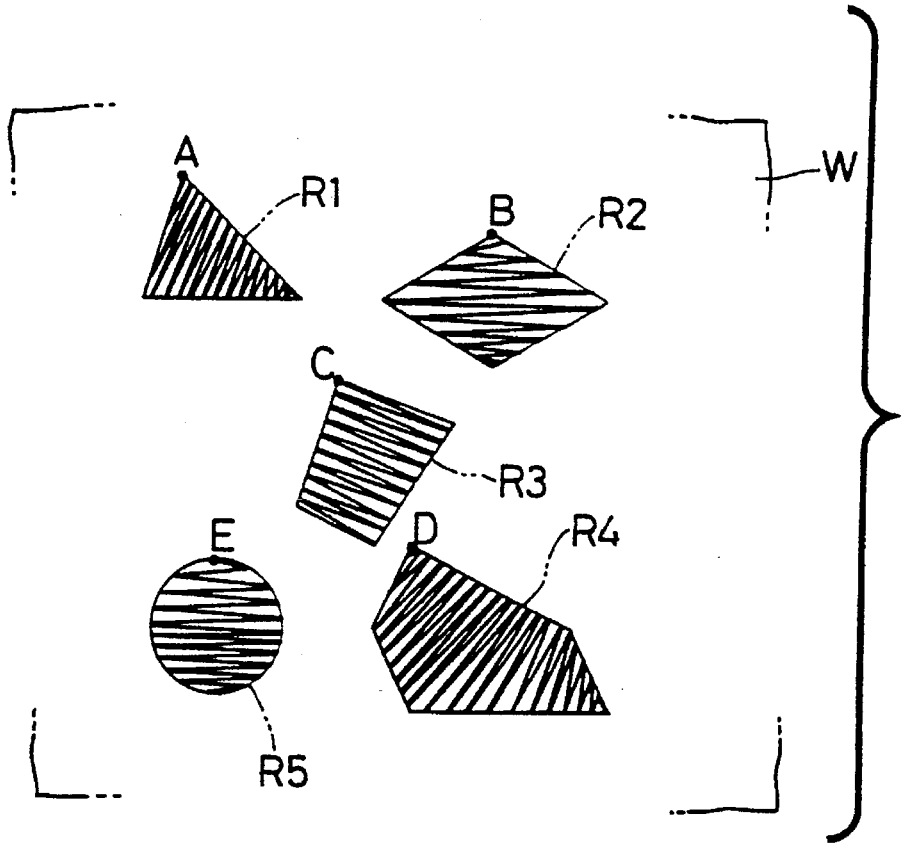
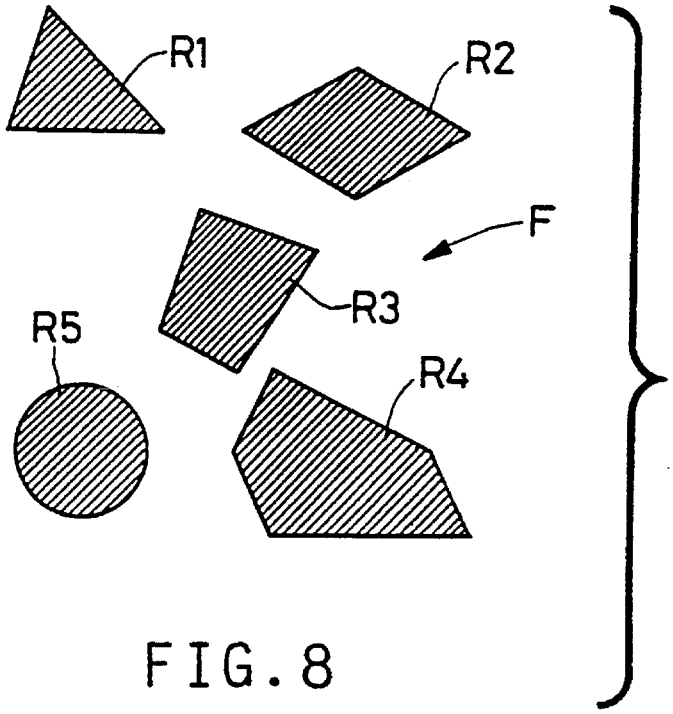
FIG. 8

FIG. 10
PRIOR ART
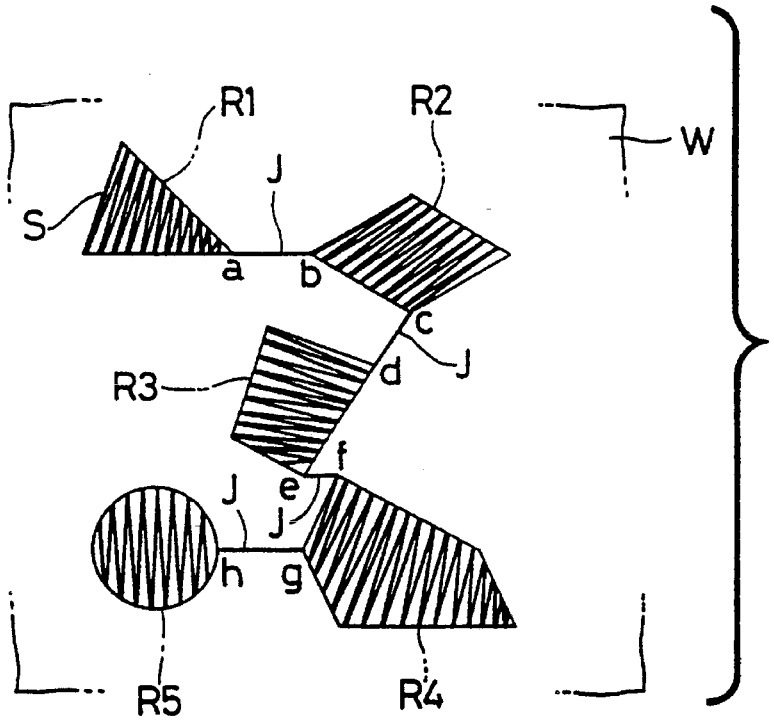
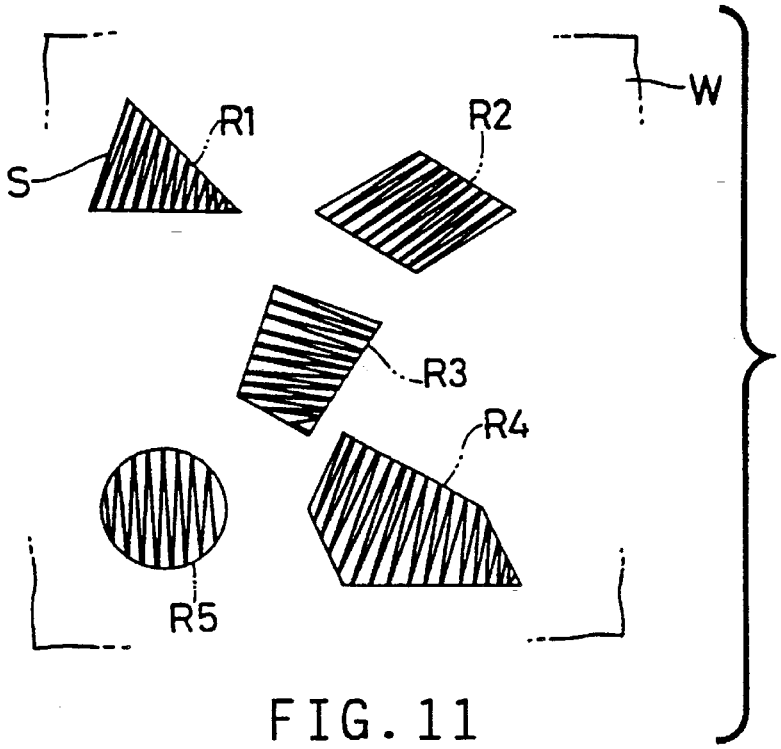
FIG. 11
PRIOR ART

EMBROIDERY DATA PRODUCING APPARATUS AND PROCESS FOR FORMING EMBROIDERY

BACKGROUND OF THE INVENTION

1. Field of the Invention

The present invention relates to an apparatus and a process for producing embroidery data to control a sewing machine to form an embroidery on a work sheet, and an embroidering product having an embroidery.

2. Related Art Statement

There is known an embroidery sewing machine which automatically forms an embroidery on a work sheet such as a work cloth while simultaneously moving the work sheet relative to a sewing needle. Embroidery data are utilized to control the sewing machine to form the embroidery. The embroidery data include, e.g., sets of stitch-position data representative of respective stitch positions on the outline of a closed area to be filled with the stitches to provide the embroidery, i.e., each stitch position corresponding to amounts of movement of the work sheet relative to the sewing needle in the X and Y directions pre-determined for the sewing machine. Embroidery data may otherwise include sets of block data representative of respective outlines of blocks as divisions of a closed area. U.S. Pat. No. 5,189,623 assigned to the Assignee of the present application discloses an embroidery data producing apparatus which automatically produces such embroidery data.

The above data producing apparatus may be constituted by (a) a personal computer (PC), (b) an image scanner, (c) a keyboard, (d) a hard disk drive (HDD), and (e) a cathode ray tube (CRT) display. The elements (b) to (e) are connected to the PC. The image scanner is operated to read in an original image from an original (e.g., sheet of paper), so that the PC produces original-image data representative of the original image. Next, the PC produces one or more sets of outline data representative of the outline or outlines of one or more closed areas constituting the original image. Furthermore, the PC produces embroidery data, e.g., sets of stitch-position data representative of respective stitch positions on the outline of each of the closed area or areas where satin stitches, for example, are formed to fill the inside of each closed area.

FIG. 8 shows an original image, F, constituted by five closed areas, R1 through R5, separate from one another. The hatching of the closed areas R1–R5 indicates that each hatched area R1–R5 is to be embroidered, i.e., filled with stitches. The above-identified conventional apparatus may produce embroidery data to control a sewing machine to sequentially embroider, on a work sheet, W, the closed areas R1–R5 by filling each closed area R1–R5 with satin stitches S and connecting each pair of successive closed areas R1–R2, R2–R3, R3–R4, R4–R5 with a jump stitch, J, as shown in FIG. 9. Additionally, the conventional apparatus determines the embroidery start and end positions of each closed area R1–R5 such that a jump stitch or thread J connecting the end position of one closed area R1–R4 and the start position of the next closed area R2–R5 takes a minimum length.

According to the embroidery data, the sewing machine first forms satin stitches S to fill the closed area R1 by ending at a position, a, subsequently forms a jump stitch J connecting the end position a and the start position, b, of the next closed area R2, and then forms satin stitches S to fill the closed area R2. Further, a jump stitch J is formed from the end position, c, of the closed area R2 to the start position, d, of the next closed area R3, and then satin stitches S are formed in the closed area R3.

After the five closed areas R1–R5 are filled with the satin stitches S by being connected to one another with the four jump stitches J, a worker or user removes the jump stitches or threads J by cutting the opposite or both ends of each thread J using, e.g., a pair of scissors. Finally, is obtained an embroidering product W having an embroidery F as shown in FIG. 11.

However, the embroidery F formed according to the embroidery data produced by the conventional data producing apparatus, needs a scissors-using cutting operation at each of the great number of positions a to h for removing the jump stitches or threads J. This work is very cumbersome and time-consuming for the worker or user.

SUMMARY OF THE INVENTION

It is therefore an object of the present invention to provide an apparatus and a process for producing embroidery data to control a sewing machine to form an embroidery by sequentially filling with stitches a plurality of closed areas separate from each other, wherein the embroidery produced contributes to minimizing the work of removing jump stitches or threads therefrom. The present invention also relates to an embroidering product enjoying the same advantage.

The above objects have been achieved by the present invention. According to a first aspect of the present invention, there is provided an apparatus for producing embroidery data to control a sewing machine to form, on a work sheet, an embroidery by sequentially filling with stitches a plurality of closed areas separate from each other, the apparatus comprising: a memory which stores a plurality of sets of closed-area data each of which represents a corresponding one of the closed areas; and producing means for producing, based on the sets of closed-area data, the embroidery data to control the sewing machine to embroider each of the closed areas by starting and ending at at least one of (a) a substantially same position and (b) respective positions adjacent to each other. The producing means may comprise means for determining a literally same position as (a) the substantially same position. Alternatively, the producing means may comprise means for determining (b) the adjacent positions such that a distance between the adjacent positions is not greater than 5 mm, more preferably, 2 mm. Stop sewing may be carried out at the embroidering start or end position of each closed area.

In the embroidery formed according the embroidery data produced by the data producing apparatus constructed as described above, jump stitches or threads are left between each pair of successive closed areas. The jump stitches or threads must be removed by cutting the opposite ends of the threads using, e.g., a pair of scissors. According to the principle of the present invention, the embroidering of each closed area starts and ends at at least one of (a) a substantially same position and (b) respective positions adjacent to each other. Therefore, the end portion of the jump thread connecting one closed area and the preceding closed area is located adjacent to the start portion of the jump thread connecting that one closed area and the following or next closed area. Hence, the two jump threads adjacent to each other are easily cut at once, i.e., by one cutting operation using the scissors. Thus, the embroidery data produced by the present data producing apparatus contribute to minimizing the work of removing the jump stitches or threads.

In a preferred embodiment of the above-described embroidery data producing apparatus, the producing means comprises: means for determining (a) the substantially same position at an extreme end of the each closed area with respect to a reference direction; and means for determining an order of embroidering of the closed areas such that one closed area whose extreme end is more extreme than that of another closed area with respect to the reference direction precedes the another closed area in the embroidering order. In this case, the embroidering end position of the one or first closed area is more extreme than the embroidering start position of the another or second closed area with respect to the reference direction. Therefore, the jump stitch or thread connecting the end and start positions of the two successive closed areas never runs through the inside of the second closed area which has not been filled with stitches yet. Thus, the stitches filling the second closed area never overlap the jump stitch or thread. This also contributes to minimizing the work of removing the jump threads.

According to a second aspect of the present invention, there is provided an embroidering product having an embroidery formed by filling with stitches a plurality of closed areas separate from each other, wherein the improvements comprise: each of the closed areas being embroidered by starting and ending at at least one of (a) a substantially same position and (b) respective positions adjacent to each other.

The above embroidering product enjoys the same advantages as those of the embroidery formed on the work sheet according to the embroidery data produced by the above-described embroidery data producing apparatus.

In a preferred embodiment of the embroidering product, (a) the substantially same position is located at an extreme end of the each closed area with respect to a reference direction.

According to a third aspect of the present invention, there is provided a process of producing embroidery data to control a sewing machine to form, on a work sheet, an embroidery by sequentially filling with stitches a plurality of closed areas separate from each other, the process comprising the step of: producing the embroidery data to control the sewing machine to embroider each of the closed areas by starting and ending at at least one of (a) a substantially same position and (b) respective positions adjacent to each other.

The embroidery data producing process arranged as described above enjoys the same advantages as those of the above-described embroidery data producing apparatus.

In a preferred embodiment of the embroidery data producing process, the step of producing the embroidery data comprises determining (a) the substantially same position at an extreme end of the each closed area with respect to a reference direction; and determining an order of embroidering of the closed areas such that one closed area whose extreme end is more extreme than that of another closed area with respect to the reference direction precedes the another closed area in the embroidering order.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings in which:

FIG. 3 is a view of a screen of a CRT display of the apparatus of FIG. 1, the screen displaying an original image obtained from an original;

FIG. 4(*b*) is a view for explaining the embroidering of another closed area carried out by an embroidery sewing machine according to the embroidery data produced by the apparatus of FIG. 1;

FIG. 5 is a plan view of a work sheet just after the embroidering of all closed areas is completed;

FIG. 6 is a view for explaining the removing of a jump stitch or thread carried out by a worker or user using a pair of scissors;

FIG. 7 is a plan view of the work sheet of FIG. 5 after the jump threads have been removed;

FIG. 8 is a view of an original image on an original;

FIG. 10 is a plan view of a work sheet just after the embroidering of all closed areas is carried out according to the embroider data produced by the conventional data producing device; and FIG. 11 is a plan view of the work sheet of FIG. 10 after jump threads have been removed therefrom.

DETAILED DESCRIPTION OF THE PREFERRED EMBODIMENTS

There will be described an embroidery data producing apparatus embodying the present invention, by reference to FIGS. 1 through 8. The following description relates to the operation of the invention apparatus (FIG. 1) for producing embroidery data for embroidering, e.g., an original image, F, (FIG. 8) constituted by five closed areas, R1 through R5, separate from each other. The original image or embroidery F has been mentioned above in explaining the related art of the present invention.

Figure 1:
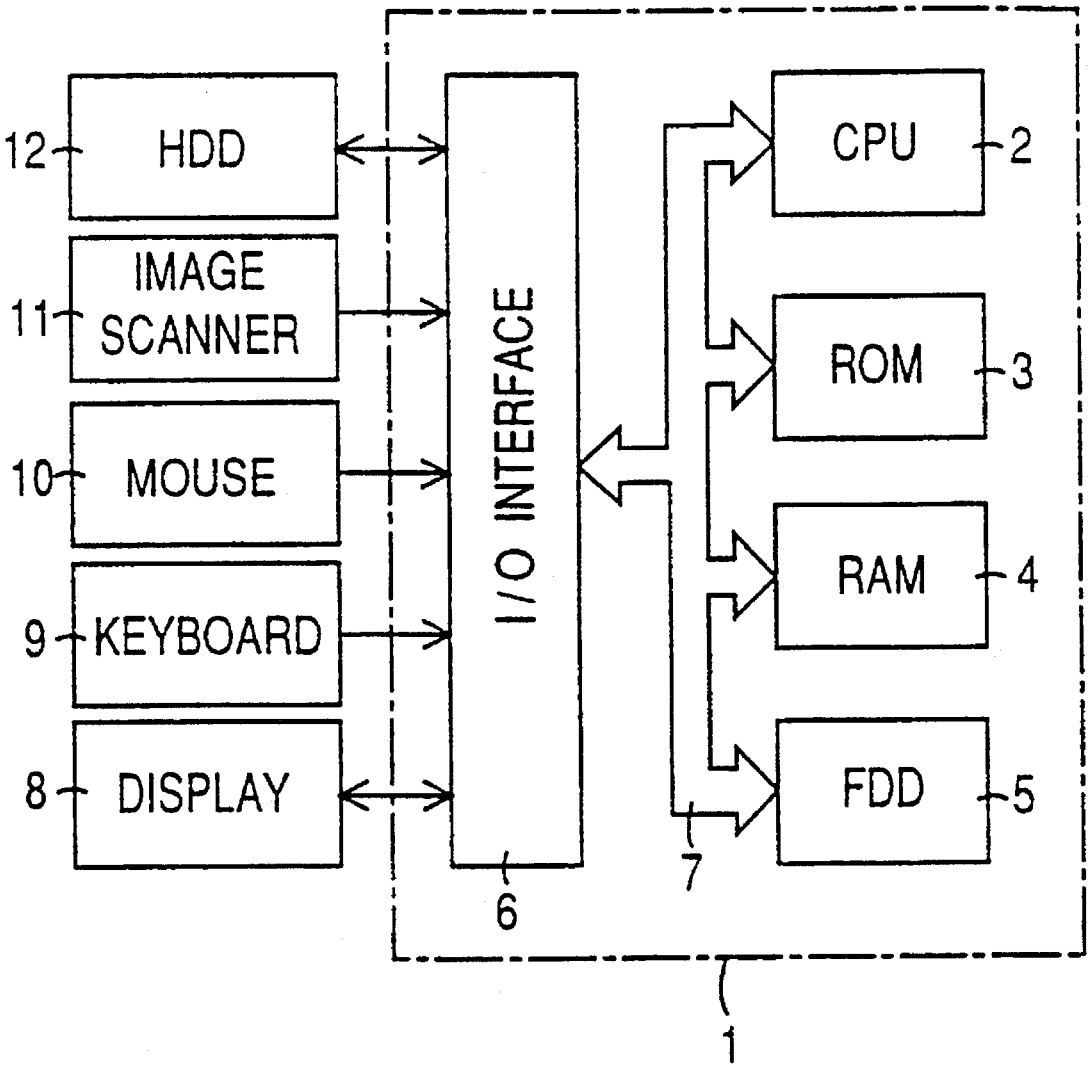
FIG. 1 is a diagrammatic view of the electronic arrangement of the embroidery data producing apparatus embodying the present invention.
Figure 9:
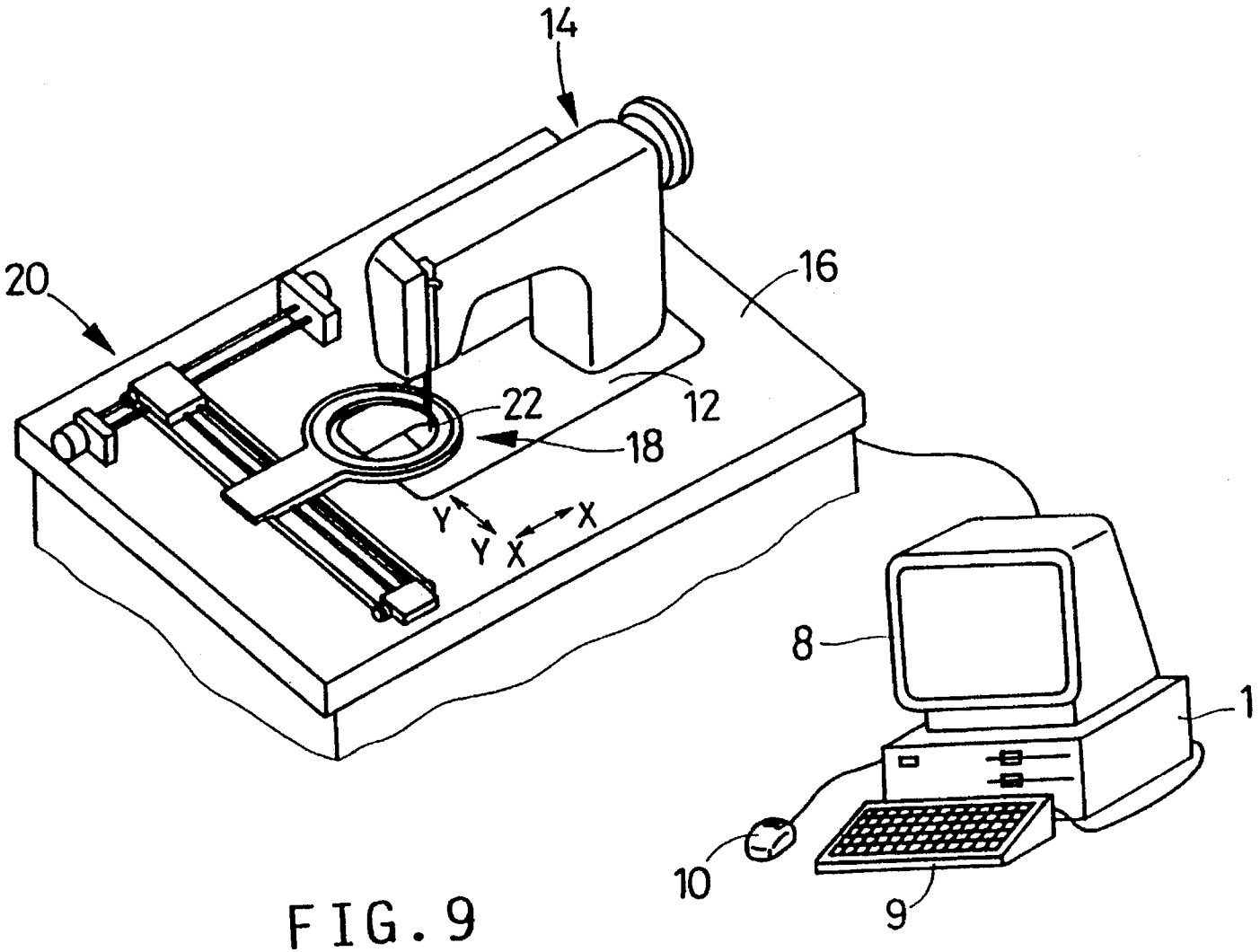
FIG. 9 is a perspective view of an embroidery sewing machine to which the apparatus of FIG. 1 may be connected.

FIG. 9 shows an embroidery sewing machine 14 which automatically forms the embroidery F on a work sheet, W, (FIG. 5) such as a cloth, fabric or leather according to the embroidery data produced by the apparatus of FIG. 1. As shown in FIG. 9, the sewing machine 14 includes a machine bed 16; an embroidery frame 18 for supporting the work sheet W; an X-Y feed mechanism 20 for moving the embroidery frame 18 to a desired position in a horizontal plane defined by an X-Y coordinate system provided for the sewing machine 14; a sewing needle 22 for conveying a needle thread (not shown); and a loop catcher (not shown) provided in the machine bed 16 for catching a loop of the needle thread conveyed by the sewing needle 22; and a drive mechanism (not shown) for reciprocating the sewing needle and rotating the loop catcher in synchronism with each other; and a control device (not shown) which may be constituted by a microcomputer and which operates for controlling the feed and drive mechanisms to automatically form the embroidery F on the work sheet W according to the embroidery data produced by the apparatus of FIG. 1.

The embroidery data produced by the apparatus of FIG. 1 may include sets of stitch-position data (e.g., X and Y coordinate data) which represent respective stitch positions on the outline of each of the closed areas R1–R5 where the sewing needle 22 penetrates the work sheet W to form corresponding satin stitches S (FIG. 5). In this case, each set of stitch-position data is representative of respective amounts of movement of the work sheet W or embroidery frame 18 along the X and Y axes to form a corresponding satin stitch. Alternatively, in the case where an original image includes a closed area, like an area R6 shown in FIG. 4(*b*), constituted by a plurality of blocks, the embroidery data produced may include sets of block data each of which represents the outline of a corresponding block. In the latter case, the control device of the sewing machine 14 may be programmed to produce sets of stitch-position data based on the sets of block data and a set of stitch-density data representative of a number of stitches to be formed in unit length or in each block.

As shown in FIG. 9, the apparatus of FIG. 1 may be connected to the sewing machine, so that the embroidery data produced by the invention apparatus may directly be transferred to the control device of the sewing machine 14 on an "on-line" basis. Alternatively, the embroidery data produced by the invention apparatus may be recorded in a magnetic disk (e.g., floppy disk) or a random-access-memory (RAM) card, so that the disk or card may be removed from the invention apparatus and then inserted into a data reading device (not shown) of the sewing machine 14, i.e., on a "off-line" basis. Otherwise, the apparatus of FIG. 1 may be incorporated into the embroidery sewing machine of FIG. 9.

Next, the arrangement of the invention apparatus will be described in detail by reference to FIG. 1. The invention apparatus may essentially be constituted by a widely used personal computer (PC) 1 including a central processing unit (CPU) 2, a read only memory (ROM) 3, a random access memory (RAM) 4, a floppy disk drive (FDD) 5, and an input and output (I/O) interface 6 which are connected to one another via bus 7. The FDD 5 holds a floppy disk as an external memory.

The invention apparatus additionally includes a cathode ray tube (CRT) display 8 having a screen 8*a* (FIG. 3) for displaying an original image to be embroidered; a keyboard 9 operable by an operator for inputting various command data into the PC 1; a mouse 10 operable by the operator for moving a cursor (not shown) on the screen 8*a* of the CRT display 8; an image scanner 11 for obtaining, as original-image data, an original image from an original, e.g., sheet of paper; and a hard disk drive (HDD) 12 for storing the embroidery data produced. The HDD 12 includes a hard disk as another external memory. The CRT display 8, keyboard 9, mouse 10, image scanner 11, and HDD 12 are connected to the PC 1 via the I/O interface 6.

In the present embodiment, the PC 1 is pre-programmed to automatically produce embroidery data based on an original image. For producing the embroidery data, first, the image scanner 11 is operated to read in an original image from an original, so that the PC 1 produces original-image data representing the original image. Subsequently, the PC 1 extracts the outline or outlines of the original image, thereby producing a set or sets of outline data representing the outline or outlines of the original image. In the case where the original image is comprised of the five closed areas R1–R5 as shown in FIG. 8, the PC 1 produces five sets of outline data each of which represents the outline of a corresponding one of the closed areas R1–R5. The sets of outline data are temporarily stored in the RAM 4 of the PC 1. Based on the stored sets of outline data, the PC 1 produces embroidery data to control the sewing machine 14 to form, on the work sheet W, an embroidery F by sequentially filling each of the five closed areas R1–R5 with satin stitches S. However, original-image data or sets of outline data may be pre-stored in a floppy disk or RAM card, and the FDD 5 may be used for reading the image data or outline data from the disk or card.

As shown in FIG. 8, the five closed areas R1–R5 are separate from each other. The PC 1 produces embroidery data to control the sewing machine 14 to sequentially embroider the five closed areas R1–R5, each area by starting and ending at (a) a substantially same position and/or (b) respective positions adjacent to each other. In the case of (a) the substantially same position, the embroidering start and end positions may coincide with each other at a literally same position. In the case of (b) the adjacent positions, it is preferred that the distance between the start and end positions be not greater than 5 mm, more preferably 2 mm, for the reasons described later. The start position of each closed area R1–R5 is the first stitch position where the sewing needle 22 first penetrates the work sheet W in each closed area R1–R5, and the end position of each closed area R1–R5 is the last stitch position where the sewing needle 22 last penetrates the work sheet W in each closed area R1–R5.

As shown in FIG. 3, an X-Y coordinate system is provided for the screen 8*a* of the CRT display 8. In the present embodiment, the PC 1 determines the start and end positions at an extreme end of each of the five closed areas R1–R5 with respect to the Y axis (i.e., positive Y direction) of the X-Y coordinate system, and determines the order of embroidering of the five closed areas R1–R5 such that one closed area whose extreme end is more extreme than that of another closed area with respect to the positive Y direction precedes that another closed area in the embroidering order.

Figure 2:
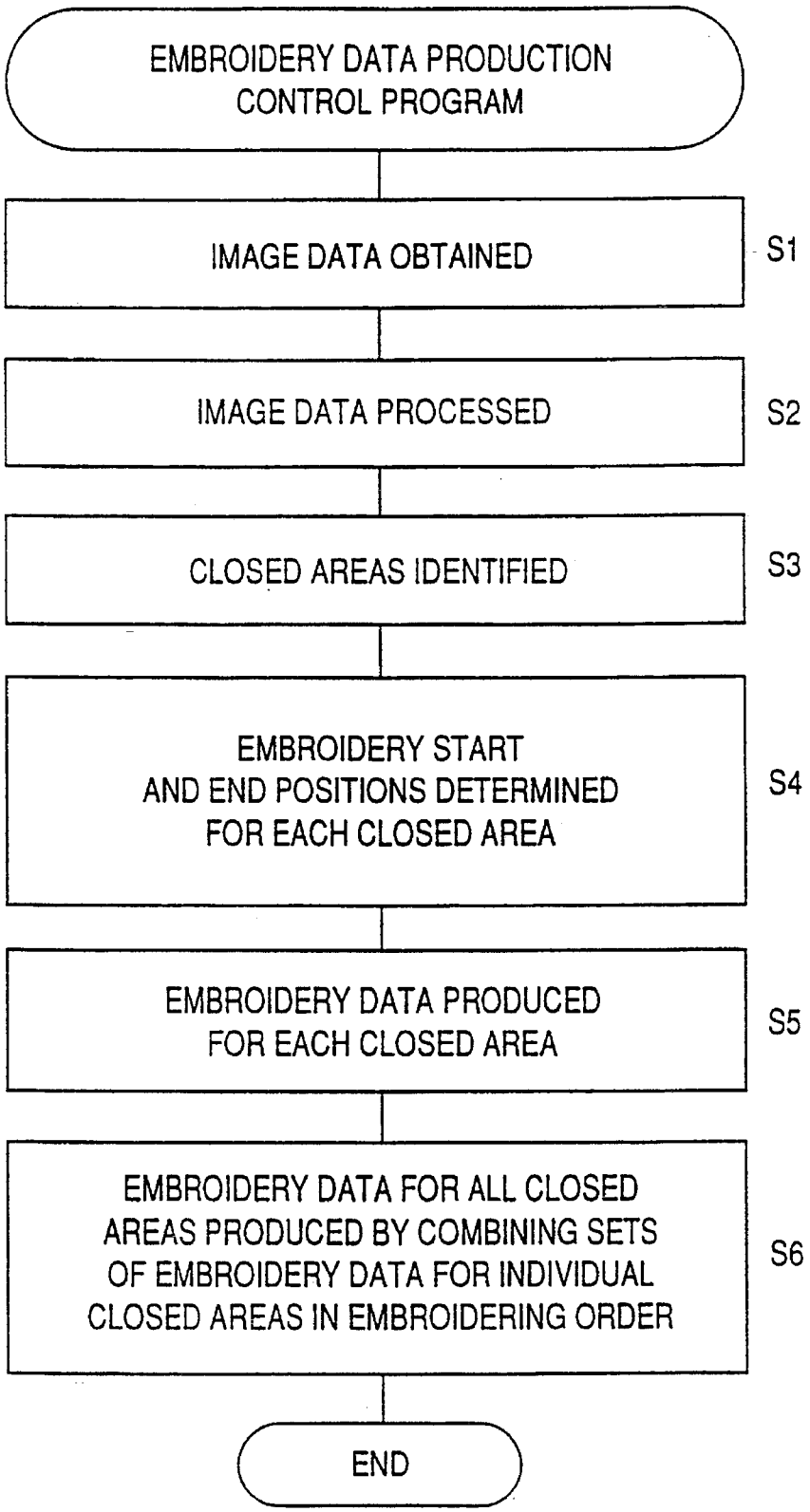
FIG. 2 is a flow chart representing the embroidery data production control program used by the apparatus of FIG. 1.

There will be described the operation of the embroidery data producing apparatus of FIG. 1, by reference to the flow chart of FIG. 2 representing the embroidery data production control program. As shown in FIG. 8, the five closed areas R1–R5 include the triangular area R1, rhombic area R2, quadrangular area R3, pentagonal area R4, and circular area R5. The embroidery F is formed by filling the five closed areas R1–R5 with satin stitches S.

First, at Step S1 of FIG. 2, the CPU 2 of the PC 1 commands the image scanner 11 to obtain, as original-image data (i.e., dot data), an original image, F, from an original, i.e., white sheet of paper bearing black-colored areas R1–R5 (although the areas R1–R5 are hatched in FIGS. 3 and 8). At the following Step S2, the CPU 2 processes the original-image data, for example, reduces the size of the original image F and/or removes noise from the image data.

Step S2 is followed by Step S3 to identify the "black" areas R1–R5 from the "white" background of the original. This is accomplished by scanning the original-image data (i.e., dot data) from the left-hand end toward the right-hand end along each of the horizontal dot lines. When a series of continuous "black" dots are found in each horizontal dot line, two opposite ends of the continuous "black" dots are identified as points defining the outline of a closed area. When a single "black" dot is found, the "black" dot is identified as a point defining the outline of a closed area. Thus, the five closed areas R1–R5 are identified in the original-image data. The CPU 2 operates for producing five sets of outline data representing the outlines of the five closed areas R1–R5. Each set of outline data includes sets of X and Y coordinate data representative of respective positions of the "black" dots or points defining the outline of a corresponding closed area R1–R5. Furthermore, the CPU 2 of the PC 1 commands the CRT display 8 to display the original image F, i.e., closed areas R1–R5 on the screen 8*a*.

Step S3 is followed by Step S4 to determine, for each of the five closed areas R1–R5, the embroidering start and end positions at an extreme end of each closed area R1–R5 with respect to a reference direction, i.e., positive Y direction. That is, a point having the greatest Y coordinate, i.e., top end as seen in FIG. 3 is selected as the start and end positions of each closed area R1–R5. Thus, a point, A, is selected as the extreme end of the area R1; a point, B, for the area R2; a point, C, for the area R3; a point, D, for the area R3; and a point, E, for the area R5.

After the start and end positions of each of the closed areas R1–R5 have been selected, the control of the CPU 2 goes to Step S5 to produce a set of embroidery data for each of the closed areas R1–R5. A set of embroidery data includes sets of stitch-position data representing respective stitch positions on the outline of a corresponding closed area R1–R5, so that the sewing machine 14 forms satin stitches, S, to fill the closed area R1–R5.

Figure 4B:
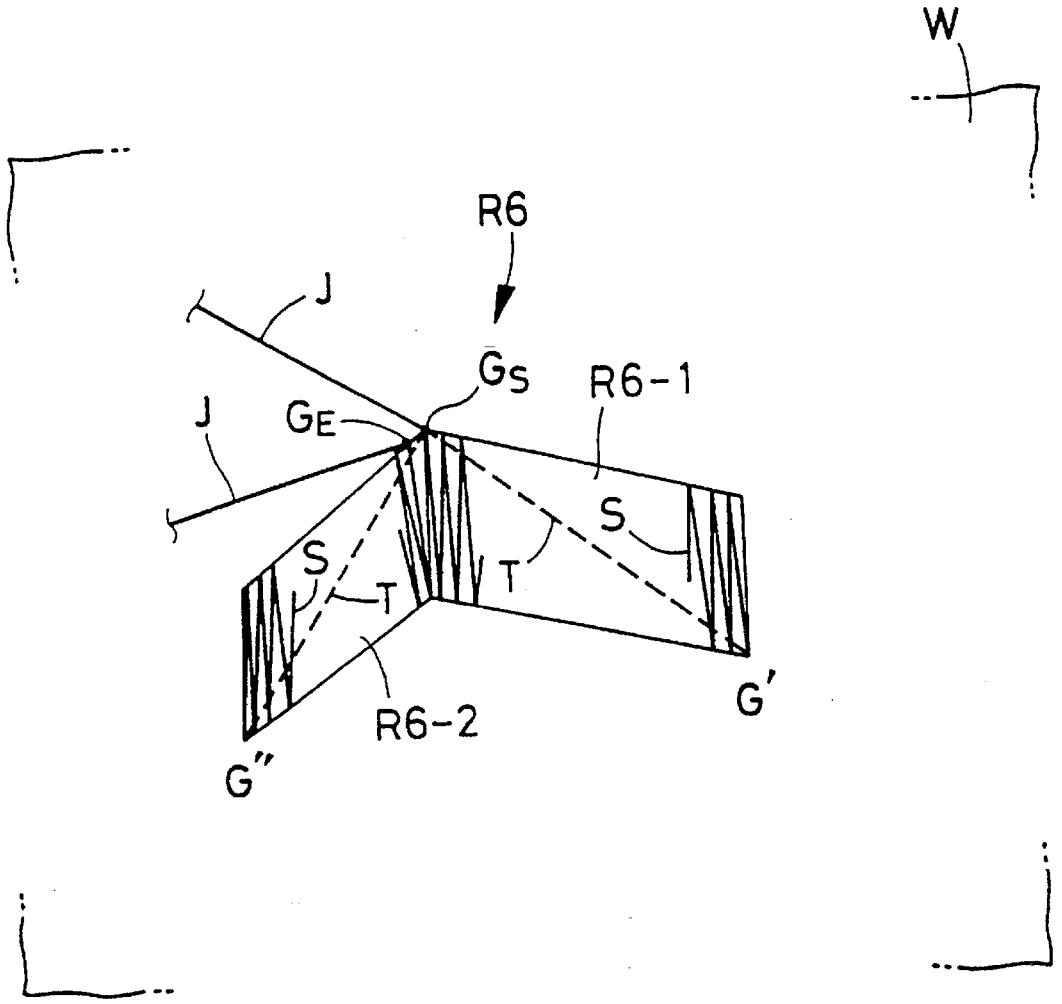
FIG. 4(*a*) is a view for explaining the embroidering of a closed area carried out by an embroidery sewing machine according to the embroidery data produced by the apparatus of FIG. 1.

For locating both the start and end positions at the single, same point in each of the closed areas R1–R5, for example, in the closed area R2, the CPU 2 determines a position, B', most distant from the extreme end B, on the outline of the closed area R2, as shown in FIG. 4(*a*), and then produces, as a portion of the embroidery data, sewing data for forming, e.g., one or more stitches such as seed stitches, T, for connecting the extreme end B and the most distant position B' such that the connecting stitches T do not run outside the closed area R2. The set of embroidery data for the closed area R2 additionally includes sets of stitch-position data for forming satin stitches S from the most distant position B' to the end position (i.e., start position) B for filling the closed area R2. The connecting stitches T are covered by the satin stitches S formed, so that the seed stitches or threads T become invisible.

Step S5 is followed by Step S6 to provide a batch of embroidery data for the embroidery F by combining the five sets of embroidery data for the five closed areas R1–R5, i.e., connecting each pair of successive areas R1–R2, R2–R3, R3–R4, R4–R5 with a jump stitch, J. For forming the jump stitch J, the sewing needle 22 jumps from the extreme end of one closed area to that of the next closed area. Additionally, the CPU 2 determines the order of embroidering of the five closed areas R1–R5 such that one closed area whose extreme end is more extreme, i.e., has a greater Y coordinate, than that of another closed area with respect to the positive Y direction precedes that another closed area in the embroidering order. Regarding the original image F shown in FIG. 8, embroidering will advance in the order of the areas R1, R2, R3, R4, and R5. Thus, the jump stitch J is formed between each pair of successive extreme ends A–B, B–C, C–D, D–E.

The embroidery data produced may be stored in the hard disk of the HDD 12 or in the floppy disk held in the FDD 5. In place of, or in addition to, the floppy disk, the embroidery data may be stored in a RAM card. The floppy disk or RAM card having the embroidery data may be inserted into the data reading device of the sewing machine 14, so that the sewing machine 14 forms the embroidery F in the work sheet W according to the embroidery data. Alternatively, in the case where the apparatus of FIG. 1 is connected to the sewing machine 14 as shown in FIG. 9, the embroider data produced may directly be fed to the control device of the sewing machine 14.

The sewing machine 14 forms the embroidery F comprised of the five closed areas R1–R5 each filled with the satin stitches S, as shown in FIG. 5. Specifically, first, satin stitches S are formed in the first closed area R1, subsequently a jump stitch J is formed from the end position A of the closed area R1 to the start position B of the second closed area R2, and then satin stitches S are formed in the closed area R2.

In this way, last, satin stitches S are formed in the fifth closed area R5. At the start and end positions of each closed area R1–R5, stop sewing is carried out by forming a few stitches for preventing the thread from loosening after having been cut.

On the work sheet W just after the embroidering of the closed areas R1–R5 is completed, the four jump stitches J remain between the closed areas R1–R5. Hence, subsequently, a worker or user cuts the both ends of each jump stitch J by using, e.g., a pair of scissors, thereby removing the unnecessary threads J, as shown in FIG. 6. Finally, is obtained an embroidery product W having an embroidery F as shown in FIG. 7.

In the present embodiment, since the embroidering start and end positions coincide with each other in each of the closed areas R1–R5, the terminal portion of a jump stitch or thread J from a preceding closed area to an appropriate closed area is located adjacent to the initial portion of a jump stitch or thread J from the appropriate closed area to a following or next closed area. Regarding the area R4, for example, the terminal portion of the jump thread J from the area R3 to the area R4 and the initial portion of the jump thread J from the area R4 to the area R5 are both located adjacent to the extreme end D. Therefore, the two jump threads J can simultaneously be cut out at once using a pair of scissors. All the four jump threads J can be removed by five cutting operations. However, the start and end positions determined in each of the closed areas may be spaced apart from each other so long as the two jump threads associated with those positions can be cut out at once. To this end, it is preferred that the distance between the start and end positions of each closed area be not greater than 5 mm, more preferably not greater than 2 mm.

If a jump stitch J would be formed to run through a closed area which has not been filled with stitches yet, then the jump stitch or thread J would be overlapped by the stitches formed to fill the closed area. This is a disadvantage because it is difficult to remove a jump stitch or thread J being overlapped by stitches filling a closed area. However, in the present embodiment, the embroidering start and end positions of each of the closed areas R1–R5 are determined at the extreme end of each closed area R1–R5 with respect to the positive Y direction pre-determined for the screen 8*a* of the display 8, and the order of embroidering of the closed areas R1–R5 are determined such that one closed area whose extreme end is more extreme than that of another closed area with respect to the positive Y direction precedes that another closed area in the embroidering order. Regarding the example F shown in FIG. 5, the point B of the closed area R2, for example, is the extreme end of the area R2 with respect to the positive Y direction, and the extreme end A of the closed area R1 is more extreme than the extreme end B of the closed area R2 with respect to the positive Y direction. Therefore, the jump stitch J from the point A to the point B never runs through the next closed area R2 which has not been filled with stitches yet.

Thus, no jump stitch J is never overlapped by stitches filling any closed area. For example, although the jump stitch J from the point B to the point C passes through the closed area R2, the jump stitch J is formed after the formation of stitches filling the closed area R2. That is, the jump stitch J jumps over the satin stitches S formed in the closed area R2. Therefore, the worker or user finds no difficulty in removing the jump stitch or thread J.

In this way, the embroidery F formed according to the embroidery data produced by the present apparatus, enables the worker or user to remove two jump stitches J at once, i.e., by one cutting operation. Thus, the present apparatus results in largely reducing the number of cutting operations necessary to remove all the jump stitches J of an embroidery as compared with the conventional data producing device which needs a greater number of cutting operations at the points a to h shown in FIG. 10. Therefore, the present data producing apparatus contributes to minimizing the work of removing the jump stitches J. The present apparatus enjoys an additional advantage that the satin stitches S filling the closed areas R1–R5 are surely prevented from overlapping the jump stitches J.

While the closed areas R1–R5 of FIG. 8 have simple outlines, the apparatus of FIG. 1 may produce embroidery data for the closed area R6 having a complex outline as shown in FIG. 4(*b*). In this case, first, the CPU 2 of the PC 1 automatically divides the area R6 into a plurality of simple blocks, R6-1 and R6-2; subsequently, it determines a position G', G" most distant from an extreme end G (i.e., start position $G_S$) of the area R6, on the outline of each of two extreme blocks R6-1 and R6-2 of the area R6 with respect to opposite (i.e., positive and negative) X directions, respectively; and then it produces, as a portion of embroidery data, sewing data to control the sewing machine to form at least one stitch connecting the extreme end G ($G_S$) and the most distant position G', G" on the outline of each extreme block R6-1, R6-2 without running outside the closed area R6. In this case, the end position is determined at a point, $G_E$, adjacent to the point G ($G_S$). A region of closed area R6 is defined as a small portion of that area. Thus, adjacent points $G_S$ and $G_E$ (FIG. 4(*b*)) are located in the same region of closed area R6. The manner of dividing a complex closed area is disclosed in U.S. Pat. No. 5,191,536.

While the present invention has been described in its preferred embodiment, the present invention may otherwise be embodied.

For example, although in the illustrated embodiment the satin stitches S are employed to fill the closed areas R1–R6, it is possible to employ the seed stitches T in place of the satin stitches S. A satin stitch S connects with one stitch the opposed portions of the outline of a closed area R1–R6, whereas seed stitches T connect the opposed outline portions with two or more straight stitches. Moreover, it is possible to form stitches along the outline of a closed area R1–R6 in addition to the satin stitches S or seed stitches T.

It is to be understood that the present invention may be embodied with other changes, improvements, and modifications that may occur to those skilled in the art without departing from the scope and spirit of the invention defined in the appended claims.

What is claimed is:

1. An apparatus for producing embroidery data to control a sewing machine to form, on a work sheet, an embroidery by sequentially filling with stitches a plurality of closed areas separate from each other, the apparatus comprising:

a memory which stores a plurality of sets of closed-area data each of which represents a corresponding one of said closed areas; and producing means for producing, based on said sets of closed-area data, said embroidery data to control the sewing machine to embroider each of said closed areas by starting and ending at at least one of (a) a substantially same position and (b) respective positions adjacent to each other, said adjacent positions of each of said closed areas being in the same region of each of said closed areas.

2. An apparatus according to claim 1, wherein said producing means comprises means for determining a position corresponding to said substantially same position.

3. An apparatus according to claim 1, wherein said producing means comprises:

means for determining said substantially same position at an extreme end of said each closed area with respect to a reference direction; and means for determining an order of embroidering of said closed areas such that one closed area whose extreme end is more extreme than that of another closed area with respect to said reference direction precedes said another closed area in said embroidering order.

4. An apparatus according to claim 3, wherein said producing means comprises means for producing, as a portion of said embroidery data, sewing data to control the sewing machine to form at least one stitch connecting said extreme end of said each closed area and a position most distant from said extreme end on an outline of said each closed area without running outside said each closed area.

5. An apparatus according to claim 3, wherein said producing means comprises:

means for dividing said each closed area into a plurality of blocks;

means for determining, on an outline of each of two extreme blocks of said plurality of blocks with respect to two opposite directions, respectively, a position most distant from said extreme end of said each closed area; and means for producing, as a portion of said embroidery data, sewing data to control the sewing machine to form at least one stitch connecting said extreme end and said most distant position on the outline of said each extreme block without running outside said each closed area.

6. An apparatus according to claim 3, wherein said producing means comprises means for producing, as said embroidery data, sets of stitch-position data representing stitch positions on an outline of said each closed area where a sewing needle of the sewing machine penetrates said work sheet, said stitch positions including said extreme end of said each closed area, said embroidery data controlling said sewing needle of the sewing machine to jump from the extreme end of said one closed area to the extreme end of said another closed area.

7. An apparatus according to claim 1, wherein said memory stores said each set of closed-area data which represents an outline of said corresponding one closed area.

8. An apparatus according to claim 1, further comprising a utilizing device which utilizes said embroidery data produced by said producing means to control the sewing machine to form said embroidery on said work sheet.

9. An apparatus according to claim 8, wherein said utilizing device comprises a stitch-forming device of the sewing machine which forms said stitches to fill said closed areas and thereby provides said embroidery on said work sheet, according to said embroidery data produced by said producing means.

10. An apparatus according to claim 8, wherein said utilizing device comprises a recording device which records, in an external memory, said embroidery data produced by said producing means to control the sewing machine to form said embroidery on said work sheet.

11. An apparatus according to claim 10, wherein said recording device records said embroidery data in at least one of a floppy disk and a random-access-memory card as said external memory.

12. A process of producing embroidery data to control a sewing machine and stitching an embroidery pattern to form, on a work sheet, an embroidery by sequentially filling with stitches a plurality of closed areas separate from each other, the process comprising the steps of:

producing said embroidery data to control the sewing machine to embroider each of said closed areas by starting and ending at at least one of (a) a substantially same position and (b) respective positions adjacent to each other, said adjacent positions of each of said closed areas being in the same region of each of said closed areas; and stitching an embroidery pattern in at least two of said closed areas using said embroidery data.

13. A process according to claim 12, further comprising a step of storing a plurality of sets of closed-area data each of which represents a corresponding one of said closed areas, and wherein the step of producing said embroidery data comprises producing said embroidery data based on the stored sets of closed-area data.

14. A process according to claim 13, wherein the step of storing said sets of closed-area data comprises storing said each set of closed-area data which represents an outline of said corresponding one closed area.

15. A process according to claim 12, wherein the step of producing said embroidery data comprises determining a position corresponding to said substantially same position.

16. A process according to claim 12, wherein the step of producing said embroidery data comprises determining said substantially same position at an extreme end of said each closed area with respect to a reference direction; and determining an order of embroidering of said closed areas such that one closed area whose extreme end is more extreme than that of another closed area with respect to said reference direction precedes said another closed area in said embroidering order.

17. A process according to claim 16, wherein the step of producing said embroidery data comprises producing, as a portion of said embroidery data, sewing data to control the sewing machine to form at least one stitch connecting said extreme end of said each closed area and a position most distant from said extreme end on an outline of said each closed area without running outside said each closed area.

18. A process according to claim 16, wherein the step of producing said embroidery data comprises dividing said each closed area into a plurality of blocks; determining, on an outline of each of two extreme blocks of said plurality of blocks with respect to two opposite directions, respectively, a position most distant from said extreme end of said each closed area; and producing, as a portion of said embroidery data, sewing data to control the sewing machine to form at least one stitch connecting said extreme end and said most distant position on the outline of said each extreme block without running outside said each closed area.

19. A process according to claim 16, wherein the step of producing said embroidery data comprises producing, as said embroidery data, sets of stitch-position data representing stitch positions on an outline of said each closed area where a sewing needle of the sewing machine penetrates said work sheet, said stitch positions including said extreme end of said each closed area, said embroidery data controlling said sewing needle of the sewing machine to jump from the extreme end of said one closed area to the extreme end of said another closed area.

20. A process according to claim 12, further comprising a step of utilizing said embroidery data to control the sewing machine to form said embroidery on said work sheet.

21. A process according to claim 20, wherein the step of utilizing said embroidery data comprises processing said embroidery data to control the sewing machine to form said embroidery on said work sheet.

22. A process according to claim 20, wherein the step of utilizing said embroidery data comprises recording, in an external memory, said embroidery data to control the sewing machine to form said embroidery on said work sheet.

23. A process according to claim 22, wherein the step of recording said embroidery data comprises recording said embroidery data in at least one of a floppy disk and a random-access-memory card as said external memory.

24. A process according to claim 12, wherein the step of producing said embroidery data comprises producing stop-sewing data to control the sewing machine to carry out a stop sewing at at least one of said substantially same position and said adjacent positions.

25. An apparatus according to claim 1, wherein said plurality of closed areas comprise at least three closed areas, and wherein said producing means comprises means for producing said embroidery data to control the sewing machine to form a first single jump stitch connecting between a first pair of areas out of said at least three closed areas, and a second single jump stitch connecting between one area out of said first pair of areas and another area out of said at least three closed areas, so that said first and second single jump stitches are cut by a single cutting operation of a cutting tool.

26. An apparatus according to claim 1, wherein said producing means comprises means for producing said embroidery data to control the sewing machine to form at least one connecting stitch connecting one of said substantially same position and said adjacent positions, with a position which is distant therefrom and is located on an outline of said each closed area without running outside said each closed area, and to subsequently form said stitches filling said each closed area and thereby covering said connecting stitch.

27. A process according to claim 12, wherein said plurality of closed areas comprise at least three closed areas, and wherein the step of producing said embroidery data comprises producing said embroidery data to control the sewing machine to form a first single jump stitch connecting between a first pair of areas out of said at least three closed areas, and a second single jump stitch connecting between one area out of said first pair of areas and another area out of said at least three closed areas, so that said first and second single jump stitches are cut by a single cutting operation of a cutting tool.

28. A process according to claim 12, wherein the step of producing said embroidery data comprises producing said embroidery data to control the sewing machine to form at least one connecting stitch connecting one of said substantially same position and said adjacent positions, with a position which is distant therefrom and is located on an outline of said each closed area, without running outside said each closed area, and to subsequently form said stitches filling said each closed area and thereby covering said connecting stitch.

29. An apparatus for producing embroidery data to control a sewing machine to form, on a work sheet, an embroidery by sequentially filling with stitches a plurality of closed areas separate from each other, the apparatus comprising:

a memory which stores a plurality of sets of closed-area data each of which represents a corresponding one of said closed areas; and producing means for producing, based on said sets of closed-area data, said embroidery data to control the sewing machine to embroider each of said closed areas by starting and ending respective positions adjacent to each other, said adjacent positions of each of said closed areas being in the same region of each of said closed areas, wherein said producing means comprises means for determining said adjacent positions at an extreme end of said each closed area and a position adjacent to said extreme end in said same region, respectively, with respect to a reference direction, and means for determining an order of embroidering of said closed areas such that one closed area whose extreme end is more extreme than that of another closed area with respect to said reference direction precedes said another closed area in said embroidering order.

30. A process of producing embroidery data to control a sewing machine and stitching an embroidery pattern to form, on a work sheet, an embroidery by sequentially filling with stitches a plurality of closed areas separate from each other, the process comprising the steps of:

producing said embroidery data to control the sewing machine to embroider each of said closed areas by starting and ending at respective positions adjacent to each other, said adjacent positions of each of said closed areas being in the same region of each of said closed areas, wherein the step of producing said embroidery data comprises determining said adjacent positions at an extreme end of said each closed area and a position adjacent to said extreme end in said same region, respectively, with respect to a reference direction, and determining an order of embroidering of said closed areas such that one closed area whose extreme end is more extreme than that of another closed area with respect to said reference direction precedes said another closed area in said embroidering order; and stitching an embroidery pattern in at least two of said closed areas using said embroidery data.

* * * * *